US009743756B2

(12) United States Patent
Casanovas Rodriguez

(10) Patent No.: US 9,743,756 B2
(45) Date of Patent: Aug. 29, 2017

(54) PIECE OF FURNITURE HAVING A CONVERTIBLE WORK SURFACE

(71) Applicant: José Miguel Casanovas Rodriguez, Barcelona (ES)

(72) Inventor: Jose Miguel Casanovas Rodriguez, Barcelona (ES)

( * ) Notice: Subject to any disclaimer, the term of this patent is extended or adjusted under 35 U.S.C. 154(b) by 0 days.

(21) Appl. No.: 15/023,576

(22) PCT Filed: Sep. 11, 2014

(86) PCT No.: PCT/ES2014/070694
§ 371 (c)(1),
(2) Date: Mar. 21, 2016

(87) PCT Pub. No.: WO2015/040257
PCT Pub. Date: Mar. 26, 2015

(65) Prior Publication Data

US 2016/0206089 A1 Jul. 21, 2016

(30) Foreign Application Priority Data

Sep. 23, 2013 (ES) ..... 201331093 U

(51) Int. Cl.
*A47B 13/00* (2006.01)
*A47B 13/08* (2006.01)
*A47B 1/00* (2006.01)

(52) U.S. Cl.
CPC ..... *A47B 13/088* (2013.01); *A47B 1/00* (2013.01)

(58) Field of Classification Search
CPC .. A47B 1/056; A47B 1/04; A47B 1/02; A47B 3/12; A47B 3/06; A47B 87/002; A47B 12/088
USPC ..... 108/157.1, 157.11, 157.13, 159.11, 42, 108/90, 50.12, 64–67, 54.1, 26, 14, 13, 108/11, 185, 153.1, 157.16, 157.17
See application file for complete search history.

(56) References Cited

U.S. PATENT DOCUMENTS 677,632 A * 7/1901 Brewer ..... A47B 1/056 108/66
838,671 A * 12/1906 Turner ..... A47B 1/056 108/66

(Continued)

FOREIGN PATENT DOCUMENTS

CN 2047514 U 11/1989
CN 201509834 U 6/2010

(Continued)

*Primary Examiner* — Janet M Wilkens
(74) *Attorney, Agent, or Firm* — Hayes Soloway PC

(57) ABSTRACT

A piece of furniture having a convertible work surface, comprising: a lower frame suitable for supporting a surface on which a fixed part is arranged, having the fixed part a series of concave curved faces on its periphery; and a number of mobile parts having at least one convex curved face and two straight faces on the periphery thereof, said straight faces being arranged perpendicular to one another. The mobile parts are provided with means for arranging same in relation to the lower frame, in a first operating position in which the mobile parts are arranged around the fixed part, defining, together with the fixed part, a first work surface; and a second operating position in which the mobile parts are arranged on top of the fixed part, abutting along their straight faces, said mobile parts defining a second work surface.

2 Claims, 3 Drawing Sheets

(56) References Cited

U.S. PATENT DOCUMENTS 1,077,826 A * 11/1913 Frisina ..... A47B 1/04 108/63
1,266,981 A * 5/1918 Olesen ..... A47B 3/12 108/185
1,392,527 A * 10/1921 Santoro ..... A47B 1/00 108/64
1,655,607 A * 1/1928 Hueter ..... A47B 1/056 108/66
1,921,645 A * 8/1933 Williams ..... A47B 1/02 108/90
2,184,976 A * 12/1939 McFall ..... A47B 1/04 108/28
2,447,141 A * 8/1948 Shillady ..... A47B 3/12 108/185
2,634,183 A * 4/1953 Derman ..... A47B 1/00 108/157.1
4,177,305 A * 12/1979 Feingold ..... B44C 3/123 273/157 R
4,815,393 A * 3/1989 Pollak ..... A47B 1/04 108/65
5,311,826 A * 5/1994 Baggiani ..... A47B 1/056 108/166
5,341,750 A * 8/1994 Fuchs ..... A47B 87/002 108/64
5,673,631 A * 10/1997 Guns ..... A47B 87/002 108/64
7,555,989 B2 * 7/2009 Sherman ..... A47B 87/002 108/64
7,849,803 B2 * 12/2010 Conley ..... A47B 1/056 108/65
D689,309 S * 9/2013 Burt ..... D6/686
8,776,699 B2 * 7/2014 Nasseri ..... A47B 13/10 108/64
8,997,661 B1 * 4/2015 Kilday ..... A47B 13/088 108/50.12
2003/0107254 A1 * 6/2003 Willy ..... A47B 3/06 297/440.13

FOREIGN PATENT DOCUMENTS

FR 2890546 A 3/2007
TW M427853 U 5/2012
WO 2016005881 * 1/2016

* cited by examiner

PIECE OF FURNITURE HAVING A CONVERTIBLE WORK SURFACE

OBJECT OF THE INVENTION

The present invention relates to a piece of furniture with convertible work surface; said piece of furniture being a table, a stand, a platform or any other piece of furniture having a lower frame, suitable for supporting a work surface. This piece of furniture has features aimed at forming, with a series of parts, a first work surface of rectangular or quadrangular shape or a second work surface of convex curved shape, specifically circular or oval with both work surfaces having equal maximum lengths and also equal maximum widths.

FIELD OF APPLICATION

This invention is applicable to any platform, table, stand, or similar, and in general to any piece of furniture which requires a convertible work surface in order to improve its characteristics or functional requirements.

STATE OF THE ART

Both in industries and in offices, hotel and restaurant establishments, and even at a domestic level, pieces of furniture or platforms are used provided with a support or lower frame for supporting a work surface appropriate for the purpose that said element is designed for in every given case.

As it is known, the choice of a piece of furniture with round worktop or with a quadrangular worktop is complicated, especially when they are tables, since the round work surface is more comfortable for users but has the drawback that it cannot be abutted to other round or quadrangular surfaces to form a uniform surface of greater amplitude. This drawback is especially relevant in the hotel trade and in the restaurant trade where it is frequent to group together a variable number of tables to form a surface of variable dimensions and adjustable in each case to the number of users.

The shape and size of said pieces of furniture may be diverse depending on their application and depending on what they are designed for, but they generally have a work surface of determined configuration (round, oval, rectangular or mixed) it also being frequent that the shape and dimensions of the work surface may be varied by extensions which, are either integrated in the pieces of furniture and are unfolded by certain mechanisms, or are formed by supplements independent of the original piece of furniture.

In the case of square or rectangular work surfaces, there are mechanisms which enable varying their size, and even their shape, providing them with round or oval shapes by extensions or mechanisms which increase the length or the width of the initial work surface; the applicant of the invention does not know of the existence in the markets of solutions which enable varying the shape of the work surface of a piece of furniture starting from a square or rectangular shape to become a circular or oval shape, or vice-versa, with both work surfaces (the initial and the transformed) having equivalent plan dimensions, without the need to occupy greater space.

Therefore, the technical problem posed is the development of a piece of furniture which has a convertible work surface of round or rectangular to circular or oval shape, and vice-versa, and keeping its maximum dimensions constant, without the necessity of adding or removing additional elements or parts which must be stored as independent elements or retracted by more or less sophisticated mechanisms.

DESCRIPTION OF THE INVENTION

To achieve the proposed objectives, the piece of furniture with convertible work surface object of this invention, which may be a table, a stand, a platform or any other piece of furniture having a lower frame suitable for supporting a work surface, has the special characteristics of comprising at least one fixed part, mounted on the lower frame, whatever its design is, even on an already existing base, and which has a series of concave curved faces and a number of mobile parts coinciding in number with the faces of the fixed part and which have at least one concave curved face on the periphery thereof, complementary to one of the concave curved faces of the fixed part, and two straight faces perpendicular to one another.

The piece of furniture has means suitable to allow the arrangement of the mobile parts in: a) a first operating position in which the mobile parts are arranged around the fixed part, and define together with said fixed part a first work surface in the shape of a polygon, rectangle or quadrangle and; b) a second operating position in which the mobile parts are arranged on top of the fixed part, said mobile parts defining a second work surface of a circular or oval convex curved shape.

The first work surface of polygonal shape and the second work surface of convex curved shape, have equivalent dimensions. The length and the width of the first work surface and of the second work surface coincide respectively, except for design details, with the length and the width of the fixed part mounted on the lower frame.

With the elements previously described, it is enough to conveniently arrange the mobile parts in relation to the lower frame, to form: either the first work surface in the shape of a polygon, rectangle or quadrangle; or the second work surface of a circular or oval convex curved shape; in all cases allowing the use of the piece of furniture in the same space using either of these two work surfaces.

DESCRIPTION OF THE FIGURES

To complement the description being made and in order to aid towards a better understanding of the characteristics of the invention, in accordance with a preferred example of practical embodiment thereof, a set of drawings is attached as an integral part of said description wherein, with illustrative and non-limiting character, the following has been represented.

PREFERRED EMBODIMENT OF THE INVENTION

Figure 1:
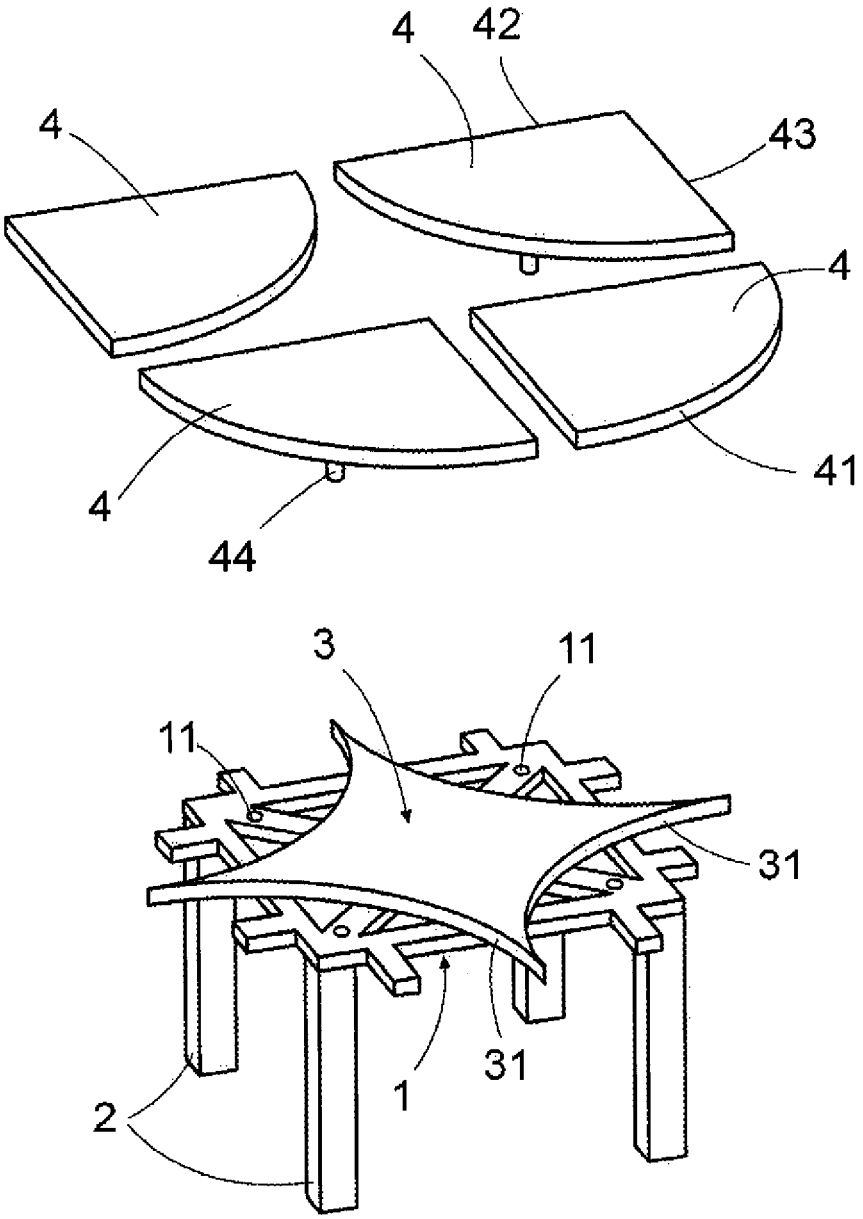
FIG. 1 shows a perspective view of an example of embodiment of a piece of furniture with convertible work surface according to the invention, represented in this case by a table and in which the mobile parts have been represented detached from the lower frame.

In the example of embodiment shown in FIG. 1, the piece of furniture of the invention is represented by a table having a lower frame (1) mounted in this case on legs (2) and suitable for supporting a fixed part (3) and a number of mobile parts (4) designed to form a convertible work surface.

The fixed part (3) is centrally mounted on the lower frame (1) and has four concave curved faces (31) on its periphery.

The mobile parts (4) are identical, coinciding in number with the concave curved faces (31) of the fixed part (3) and have a lower part, an upper part, a concave curved face (41) and two straight faces (42, 43) on the periphery thereof, perpendicular to one another.

Each one of the mobile parts (4) has in its lower part a shaft (44) which forms means suitable for allowing its rotation and its vertical displacement with respect to the lower frame (1), which has, for said purpose, orifices (11) for the housing of the corresponding shafts (44) of the parts (4). Said shafts (44) facilitate the suitable movement of the mobile parts although depending on the definitive design they may not be necessary.

Figure 2:
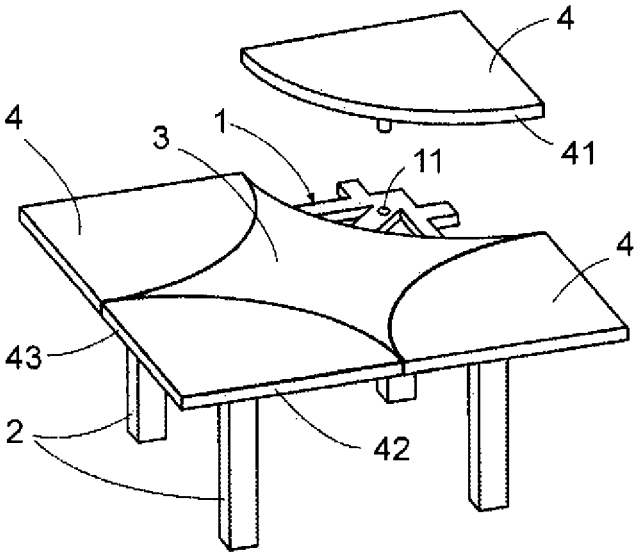
FIG. 2 shows a perspective view of the piece of furniture of the previous figure during the assembly of the mobile parts on the frame in a suitable position to form a first work surface in this case of quadrangular shape.
Figure 3:
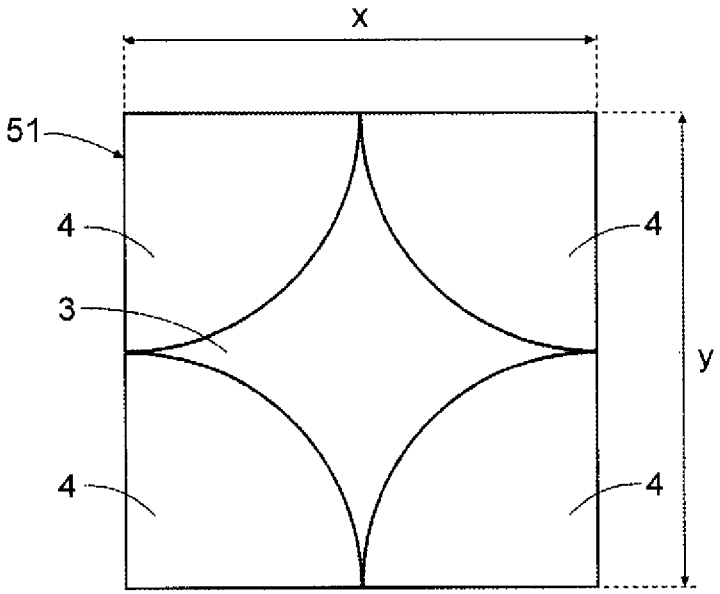
FIG. 3 shows a top plan view of the table of the previous figures after the first work surface of quadrangular shape has been formed.

As can be observed in FIG. 2, the mobile parts (4) can be positioned on the lower frame (1) so that they are arranged coplanar to the fixed part (3) and that its convex curved faces (41) are facing the respective concave curved faces (31) of the fixed part (3) so that the mobile parts (4) define, together with the fixed part (3), a first polygonal work surface (51), in this case quadrangular, referenced in FIG. 3.

This first work surface (51) has a length (x) and a width (y) coinciding with that of the fixed part (3).

Figure 4:
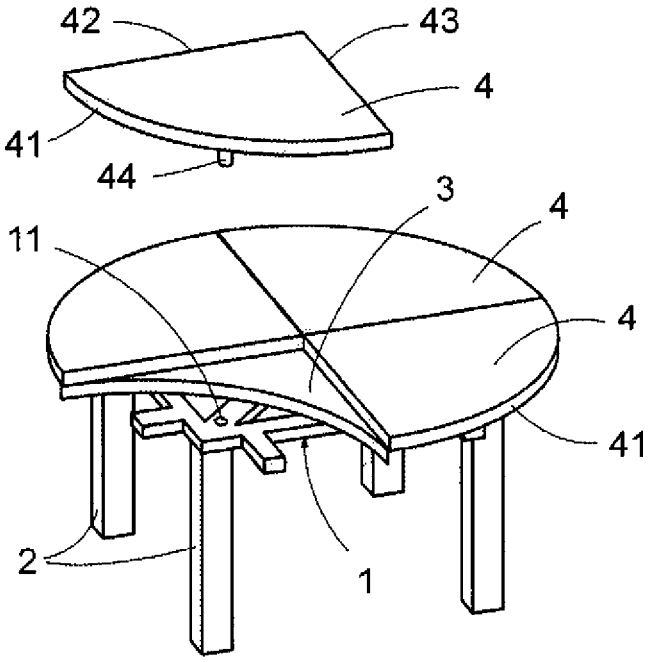
FIG. 4 shows a perspective view of the table of FIG. 1 during the assembly of the mobile parts on the frame in a suitable position to form a second work surface, in this case of circular shape.
Figure 5:
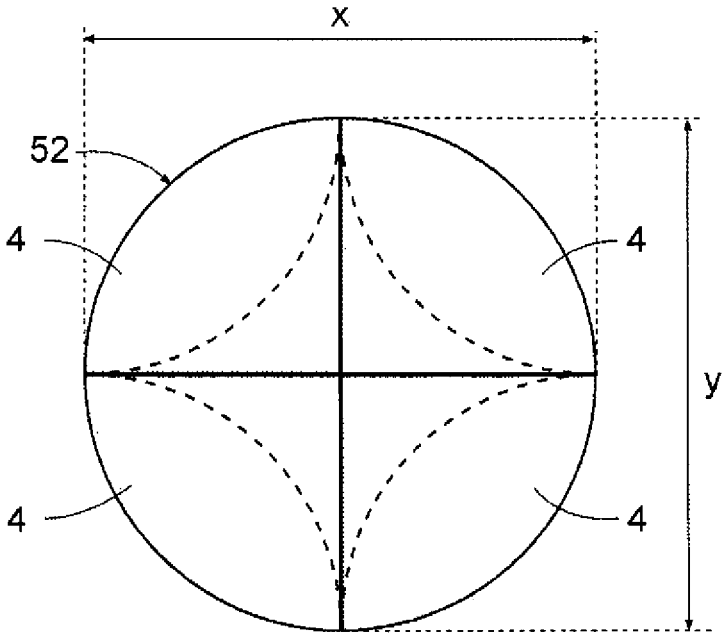
FIG. 5 shows a top plan view of the table of FIG. 4 once the second work surface has been mounted and in which the fixed part which is positioned below the mobile parts have been represented with dotted lines.

By placing the mobile parts (4) in the position represented in FIG. 4, said mobile parts are superimposed on the fixed part (3) and abutting along their straight faces (42, 43), its convex curved faces (41) forming, as observed in FIG. 5, the shape of a second curved convex work surface (52), in this case circular.

This second work surface (52) has, the same as the first work surface (51), a length (x) and a width (y) coinciding with that of the fixed part (3), which in this case is arranged below the parts (4) and which has been represented with a broken line in FIG. 5.

Once the nature of the invention has been sufficiently described, in addition to an example of preferred embodiment, it is stated that the materials, shape, size, functional or construction details and the layout of the elements may be modified or adapted to the corresponding formal or aesthetic designs, provided that it does not involve altering the essential characteristics of the invention described in the following claims.

The invention claimed is:

1. A piece of furniture with convertible work surface, the piece of furniture having a lower frame suitable for supporting a work surface, the lower frame having orifices on its surface; wherein it comprises:

at least one fixed part arranged on the lower frame; the fixed part having concave curved faces on its periphery; and mobile parts coinciding in number with the concave curved faces of the fixed part, having the mobile parts a lower part and an upper part, and which have on their periphery, at least:

one concave curved face, complementary to one of the concave curved faces of the fixed part, and two straight faces, perpendicular to one another;

wherein the mobile parts are provided on their lower part with shafts suitable for arranging into the orifices of the lower frame, in:

a) a first operating position, in which the mobile parts are arranged around the fixed part, and define together with said fixed part a first work surface in the shape of a polygon, rectangle or quadrangle; and b) a second operating position in which the mobile parts are arranged on top of the fixed part, abutting along their straight faces; said mobile parts defining a second work surface of a circular or oval convex curved shape.

2. The piece of furniture of claim 1, wherein the first work surface of polygonal shape, and the second work surface of convex curved shape, have dimensions and equivalent and coinciding, respectively, with the length and the width of the fixed part.

* * * * *